US009825433B2

(12) United States Patent
Monros

(10) Patent No.: US 9,825,433 B2
(45) Date of Patent: Nov. 21, 2017

(54) PROGRAMMABLE PLASMA IGNITION PLUG

(71) Applicant: Serge V. Monros, Costa Mesa, CA (US)

(72) Inventor: Serge V. Monros, Costa Mesa, CA (US)

( * ) Notice: Subject to any disclaimer, the term of this patent is extended or adjusted under 35 U.S.C. 154(b) by 0 days.

(21) Appl. No.: 15/470,552

(22) Filed: Mar. 27, 2017

(65) Prior Publication Data

US 2017/0214222 A1 Jul. 27, 2017

Related U.S. Application Data

(63) Continuation-in-part of application No. 14/876,618, filed on Oct. 6, 2015, now Pat. No. 9,605,645, which is a continuation of application No. 14/515,332, filed on Oct. 15, 2014, now Pat. No. 9,236,714.

(60) Provisional application No. 61/891,551, filed on Oct. 16, 2013.

(51) Int. Cl.

| | |
|---|---|
| ***H01T 13/28*** | (2006.01) |
| ***H01T 13/40*** | (2006.01) |
| ***F02P 23/00*** | (2006.01) |

(52) U.S. Cl.

CPC ..... *H01T 13/40* (2013.01); *F02P 23/00* (2013.01); *H01T 13/28* (2013.01)

(58) Field of Classification Search

CPC ..... H01T 13/40; H01T 13/28; F02P 23/00
See application file for complete search history.

(56) References Cited

U.S. PATENT DOCUMENTS

| | | | | |
|---|---|---|---|---|
| 3,854,067 | A | 12/1974 | Morgan | |
| 4,407,259 | A * | 10/1983 | Abo | F02P 7/035 123/620 |
| 4,455,989 | A | 6/1984 | Endo et al. | |
| 4,623,250 | A | 11/1986 | Onishi et al. | |
| 5,704,321 | A | 1/1998 | Suckewer et al. | |
| 6,670,740 | B2 | 12/2003 | Landon, Jr. | |
| 2005/0194877 | A1 | 9/2005 | Horn et al. | |
| 2012/0241756 | A1 | 9/2012 | Zhang et al. | |
| 2013/0167789 | A1 * | 7/2013 | Yamada | F02P 3/01 123/179.5 |
| 2013/0193834 | A1 | 8/2013 | Hill | |

OTHER PUBLICATIONS

Marschall, Roland; Semiconductor Composites: Strategies for Enhancing Charge Carrier Separation to Improve Photocatalytic Activity; Advanced Functional Materials; www.MaterialsViews.com; wileyonlinelibrary.com; 2014, 24, 2421-2440.

* cited by examiner

*Primary Examiner* — Donald Raleigh
(74) *Attorney, Agent, or Firm* — Kelly & Kelley, LLP

(57) ABSTRACT

An ignition plug wire for an internal combustion engine has an elongated conductor with a programmable capacitor module disposed in-line with the elongated conductor. The programmable capacitor module is configured to step up or convert the ignition voltage normally supplied by an ignition coil to a plasma voltage. An inventive ignition plug if configured such that the anode enclosed within the insulator includes or is replaced by a voltage converting module designed to convert the ignition voltage into a plasma voltage. The voltage converting module consists of a semiconductor circuit, a composite semiconductor material, or a capacitor.

16 Claims, 9 Drawing Sheets

PROGRAMMABLE PLASMA IGNITION PLUG

RELATED APPLICATION

This application is a continuation-in-part of U.S. application Ser. No. 14/876,618, filed Oct. 6, 2015, which is a continuation of U.S. application Ser. No. 14/515,332, filed on Oct. 15, 2014 (now U.S. Pat. No. 9,236,714), which application claims the benefit of U.S. Provisional Application No. 61/891,551, filed on Oct. 16, 2013.

BACKGROUND OF THE INVENTION

This invention is directed to an ignition source for use with internal combustion engines. More particularly, the invention is directed to a plasma ignition plug designed to replace a spark plug. The plasma generated by the inventive ignition plug increases molecular dissociation of the fuel such that virtually 100% combustion is achieved, with a decrease in heat generation, an increase in horsepower, and near complete remediation of the exhaust profile.

The purpose of this invention is to create a device for use in internal combustion engines that induces combustion of petroleum-based fuels by plasma propagation. Plasma ignition properties are not currently provided by conventional spark ignition devices such as spark plugs. The field of spark-type devices is densely populated by more than 1,000 patented spark emitter and plasma propagation devices. The field of plasma-arc igniter systems is also densely populated but largely relegated to uses not affiliated with internal combustion engines. All such devices are typically comprised of (a) an anode bar which is inserted longitudinally through the center of (b) an insulating porcelain material comprised of a vitreous or glassine ceramic of various types, (c) a fitted metallic cathode material comprised of various materials, which is affixed to the ceramic insulating material using various strategies and techniques, (d) all of which incorporate a wide variety of spark-gap geometries ranging from a simple spark bar separated from the tip of the anode bar to various types of cages, plates, layered materials, and other strategies intended to amplify or enhance the effectiveness of the spark emitted into the cylinder of the engine during ignition cycles.

The current invention is distinguished from all prior art devices of the same class by (a) the materials incorporated into its design, (b) the geometry of its ignition tip, and (c) its electronic and electrical properties. A singular and common short-coming of spark plugs in general is that the metallic elements incorporated into their manufacture are incapable of emitting a spark across the ignition gap that efficiently ignites, beyond a finite limit, the air and fuel droplets compressed in the cylinder during the detonation phase. The limitations of current 'spark emitter' devices are the product of (a) marginal conductivity of the metallic elements, (b) electrical persistence demonstrated by the metallic elements, and (c) a finite limit to electrical saturation provided by the porcelain ceramic insulating materials.

The normal air-to-fuel ratio supported by conventional devices is generally recognized as 14.7:1. Newer engines have recently been manufactured which operate at an elevated ratio of 22:1. This elevated level of air-to-fuel mixtures represents the upper limit of operability in conventional internal combustion engine devices because the amount of electrical current (including a number of variable input properties) that can be tolerated by conventional spark plugs cannot exceed this level of performance. In order to efficiently detonate a fuel-air mixture at a higher ratio the ignition source must be designed to tolerate much higher current levels, faster switching times, and higher peak amplitudes than can be supported by any currently available devices.

The present invention fulfills these needs and provides other related advantages.

SUMMARY OF THE INVENTION

A plasma ignition system for an internal combustion engine typically includes a distributor in the internal combustion engine for distributing electrical energy pulses for ignition. An ignition plug is also included, which may be in the form of a spark ignition plug or a plasma ignition plug. Spark ignition plugs are as known in the field. Plasma ignition plugs have a generally semispherical anode disposed within a generally toroidal cathode defining an annular spark gap. The semispherical anode and toroidal cathode of the plasma ignition plug are separated by an insulating body. The annular spark gap is proximate to a distal end of the insulating body and provides increased spark surface area when compared to common bar spark plugs. A plug wire connects the ignition plug to the ignition coil or distributor for transmitting the electrical energy pulses at an ignition voltage from the coil to the ignition plug.

The present invention is directed to an ignition plug wire for use with standard spark ignition plugs in internal combustion engines or plasma ignition plugs. The ignition plug wire includes an elongated conductor having a first end configured for connection to an ignition coil and a second end configured for connection to an ignition plug. The elongated conductor is configured to deliver an ignition voltage from the ignition coil to the ignition plug. The inventive ignition plug wire includes a programmable capacitor module in-line with the elongated conductor. The programmable capacitor module is disposed between the first end and the second end of the conductor, and is configured to convert the ignition voltage to a plasma voltage. A typical ignition voltage is in the range of 15,000 volts to 20,000 volts. A plasma voltage generated by the inventive ignition plug wire is greater than 500,000 volts, preferably between 500,000 volts and 600,000 volts.

The programmable capacitor module preferably includes a memory chip connected to a capacitor that is in-line with the elongated conductor. The memory chip is preferably configured to store a program for controlling the capacitor, as well as, how the capacitor converts the ignition voltage to the plasma voltage. The programmable capacitor module is preferably also configured to convert the ignition voltage from an alternating current to a direct current, such that the plasma voltage will also be direct current. The direct current may have a plus direction value so as to generate a plasma field having a clockwise rotation, or a minus direction value so as to generate a plasma field having a counter-clockwise rotation.

An inventive plasma ignition plug includes an anode concentrically disposed within a generally cylindrical cathode, and an insulator disposed between the anode and the cathode—similar to prior art ignition plugs. The inventive plasma ignition plug also includes a voltage converting module disposed within the insulator and electrically in-line with the anode. The voltage converting module is configured to convert an ignition voltage to a plasma voltage.

In a first embodiment of the inventive plasma ignition plug, the voltage converting module is a semiconductor circuit, such as a metal-oxide semiconductor field-effect transistor. The metal-oxide materials are bridged by an insulated gate material, which are both connected by a p-n junction. The semiconductor circuit further includes a memory chip configured to store a program for controlling the semiconductor circuit and how the semiconductor circuit converts the ignition voltage to the plasma voltage. As described above, the ignition voltage is typically in the range of 15,000 volts to 20,000 volts and the plasma voltage is preferably greater than 500,000 volts.

In a second embodiment, the voltage converting module includes only a capacitor. The capacitor is designed and configured to convert the ignition voltage to the plasma voltage as described.

In a third embodiment, the voltage converting module includes a composite semiconductor material in place of the anode. The composite semiconductor material includes metal-oxides. The composite semiconductor material preferably replaces the tungsten anode completely so as to rely solely upon the capacitance effects of the composite semiconductor material. Alternatively, the composite semiconductor material may replace a middle portion of the tungsten anode, such that the tungsten material expands to a larger diameter or surface area to encapsulate and/or blend with the composite semiconductor material.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
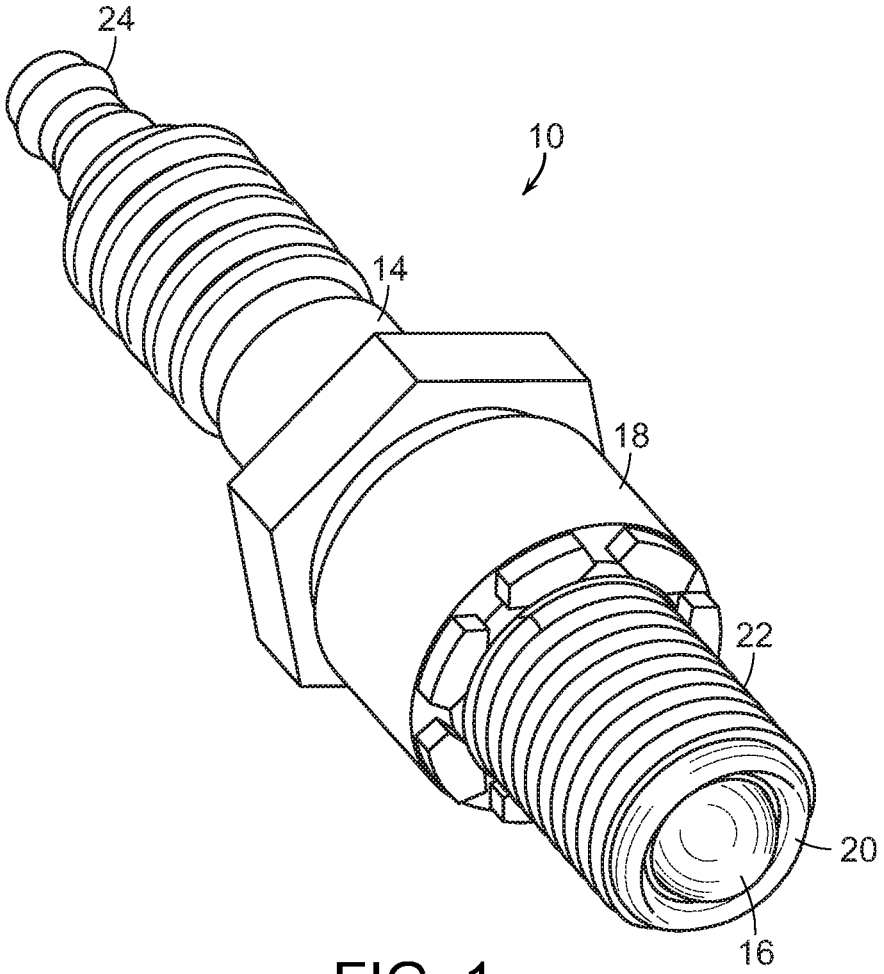
FIG. 1 is a perspective view of the plasma ignition plug of the present invention.
Figure 2:
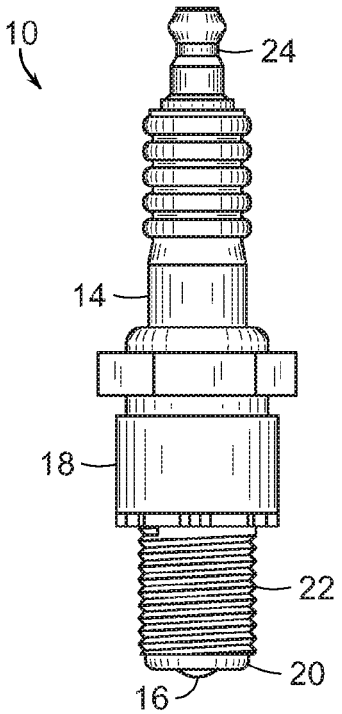
FIG. 2 is a front view of the plasma ignition plug of the present invention.
Figure 3:
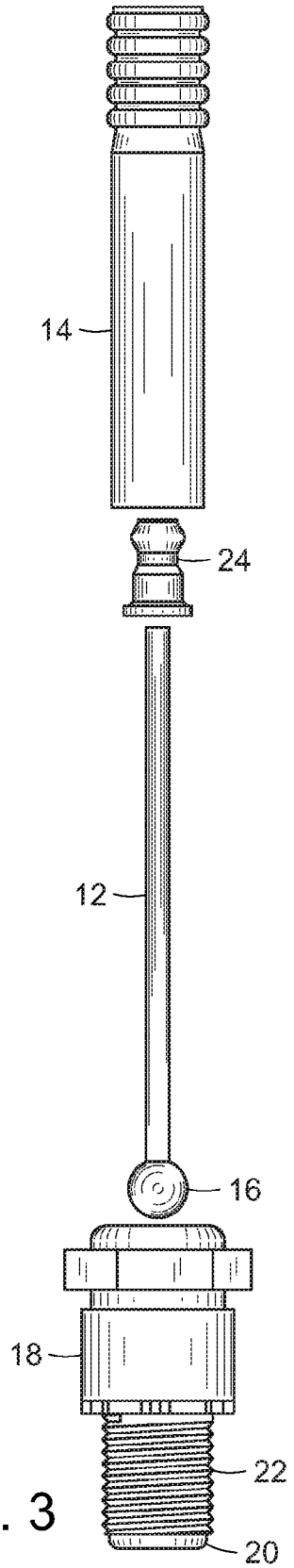
FIG. 3 is an exploded view of the plasma ignition plug of the present invention.
Figure 4:
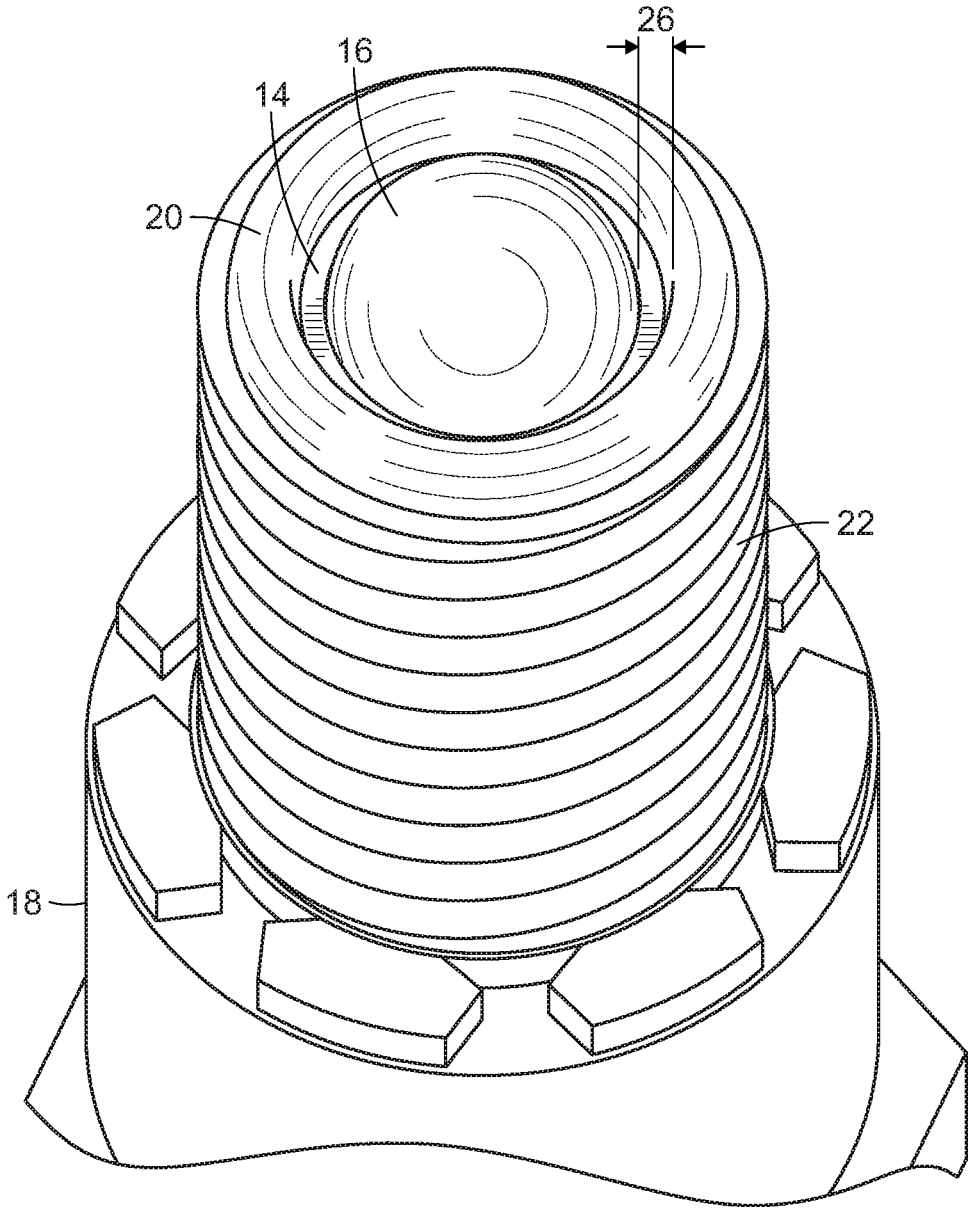
FIG. 4 is a close-up view of the annular gap of the plasma ignition plug of the present invention.

The inventive plasma ignition plug 10 is designed to accommodate a specially designed plasma emitter shown in separate tests to emit a highly energized arc-driven plasma field when subjected to a properly designed power supply and switching system. The device as shown in FIGS. 1-4 is constructed of (a) an anode 12 made from thorium-alloyed tungsten rod stock, (b) an insulator 14 made from a vitreous machinable ceramic material such as boron-nitride, (c) a hemispherical field emitter 16 made from titanium, and (d) a cathode sleeve 18 made from either beryllium-alloyed copper or vanadium-alloyed copper. The cathode 18 has a torus-shaped ring 20 near the emitter 16. The body of the cathode 18 is preferably tooled and threaded 22 to fit into an engine port configured to receive a spark plug in a typical internal combustion engine. A terminal or ignition input cap 24 is press-fitted on the end of the anode 12 opposite the cathode 18.

The inventive plasma ignition plug delivers much higher current to the ignition cycle in nanosecond bursts. Instead of simply producing an ignition arc, the inventive plasma plug produces a plasma so powerful that it disassociates water molecules in open air and burns them with a brilliant arc. When exposed to the plasma field of the inventive plasma ignition plug, gasoline molecules are broken into single ionic radicals which are then ignited by an equally powerful arc. The result is that fuel molecules are completely burned with hydrocarbon particulates being virtually eliminated in amounts less than 2.5 parts per billion. In addition, carbon monoxide is completely eliminated and the entire exhaust profile is remelted. When used in two-stroke oil additive vehicles, the six carcinogenic exhaust contaminants typically produced by such engines are completely eliminated. Vehicles tested with plasma ignition plugs according to the present invention demonstrate significant increases in horsepower output and gas mileage. Emission tests performed on such vehicles demonstrates a significant reduction or total elimination of the most dangerous exhaust contaminants. Additional components can be used with the inventive plasma ignition plugs to increase electrical discharge levels, control switching rates, recalibrate ignition timing, and recalibrate fuel-air ratios.

The current invention resolves the underlying issues of prior art spark plugs by adopting the following design distinctions:

Thorium-alloyed Tungsten Anode: Thorium-232 is useful as an alloy in devices that propagate finely controlled electronic systems because the 232 isotope of Thorium continuously emits free electrons ($6.02\times10^{17}$ per square cm/sec) without also exhibiting the release of any of the other emission products associated with nuclear decay. In the inventive plasma ignition plug 10, the free electrons supplied by the Thorium-232 increase the amount of actual electron output by the emitter by 73.91%. This amplifying feature renders the current invention functionally superior to any known devices of similar construction or application. The anode 12 is preferably made from thorium-alloyed tungsten (3%). The thorium-alloyed Tungsten anode rod allows for super fast switching with exceptionally low resistance. The material allows for free electron field saturation with virtually zero residual charge persistence.

Beryllium-alloyed Copper Cathode: Conventional iron-based metals have been used in spark plug cathode systems for more than 130 years. This convention has been adopted because steel cathodes are strong, relatively inexpensive, and ubiquitously available. The short-comings of ferrous materials in spark-plug applications only become important when desired input values breach the tolerance thresholds that can be tolerated by this kind of material. The present invention resolves this problem by substituting beryllium-alloyed copper for conventional ferrous cathode materials. The alloy of copper with beryllium has the effect of (a) increasing the tensile strength of copper, (b) increasing the softening point of copper, and (c) amplifying the conductivity of copper in environments of elevated temperatures. The cathode 18 is preferably made from beryllium-alloyed copper or vanadium-alloyed copper. The beryllium-alloyed copper cathode provides extremely high conductance with amplified dielectric potential and superior tensile strength compared to copper.

Titanium Plasma Emitter: The point of greatest exposure to deterioration in every spark-emitter type device is the tip of the spark-emitting anode. Recent advancements in materials technologies have produced anode tips that are thinly coated with materials such as platinum and iridium. When the test data of such coating materials is reviewed, it is clear that the actual output of work-function in the form of usable energy is not improved by the addition of these coating materials. Additionally, while the life-expectancy of anode tips exposed to conventional input discharge impulses may have been extended by this modification, conventional anode tips coated with platinum or iridium catastrophically fail within 15 seconds or less when exposed to the input levels required to create and propagate a continuous series of plasma bursts.

The present invention solves this problem by substituting a spherical propagation element or emitter 16 comprised of high purity titanium. The emitter 16 is preferably on the order of ¼ inch in diameter—presented as either a sphere or a hemisphere. The thorium-alloyed tungsten anode rod 12 is press-fitted to the titanium emitter 16 to constitute a strong, highly conductive component that is fundamentally resistive to deterioration under continuous operation at the levels contemplated for plasma generation. When assembled with the cathode 18, the arc of the emitter 16—whether a sphere or a hemisphere—protrudes beyond an end of the torus 20. The fact that titanium exhibits extremely low electrical capacitance in the form of residual charge persistence renders it ideal for this specific application. Titanium is also fundamentally resistant to deterioration when employed as a high voltage anode. The titanium plasma emitter provides extremely high resistance to high voltage/high amperage degradation with very low residual charge persistence, very low resistance, high surface area geometries, and extremely high temperature/pressure tolerance.

Field Propagation Mapping: The sufficiency of an electrical arc as an ignition source in internal combustion engine-type devices is a function of (a) source charge amplitude, (b) source charge duration, (c) geometry at the tip of the emitter, and (d) surface area operating between the anode and cathode elements. In conventional spark plug devices, a single bar of approximately 0.125" diameter is separated from a cathode element by a gap which is typically in the range of 0.030" +/−. The highest efficiency devices (e.g., as approved by NASCAR and Formula 1 racing organizations) consist of a single platinum-coated spark bar tip surrounded by three or more cathode tips. This configuration has been adopted because it effectively increases the surface area upon which the spark arc can operate.

The current invention optimizes the relationship between both the geometric and surface area components by using a spherical anode emitter 16 which is separated from a torus 20 of the beryllium-alloyed copper or vanadium-alloyed copper cathode 18 by a gap of approximately 0.030 inches. The tip of the emitter hemisphere protrudes beyond the end of the torus 20 by approximately 0.020 inches. The vitreous machinable ceramic insulator 14 is situated within 0.030 inches of the exposed surface of the cathode torus 20. This combination of materials, along with curved geometric sections and a closely-fixed insulator floor provides a conductive surface area which is at least twenty-five times greater than the high performance NASCAR racing-type spark plugs. In addition, the configuration of the plasma ignition plug 10 forces the plasma field away from the tip of the propagation device towards the head of the piston. The combination of increased surface area has been shown to improve combustion effectiveness and efficiency by more than 68% when compared to NASCAR-type spark plugs in identical test applications under typical 4-cycle gasoline burning internal combustion engine systems.

When high amplitude pulses are driven into the anode 12, the arc that results reaches across the annular gap 26 at more than twenty-four spots simultaneously. Under conventional input from a standard alternator and ignition system (2500 rpm at 13.5 volts DC and 30 amps, converted to 50,000 volts DC and 0.0036 amps), the inventive plasma ignition plug 10 produces twenty-five times more ignition flame front than a conventional spark plug. When the ignition level is increased 1,800 times (75,000 volts DC and 6.5 amps), the spark front is replaced by a plasma. No conventional spark plug can tolerate current input levels such as this. At these conditions, the inventive plasma ignition plug 10 increases molecular dissociation to near 100% combustion with a decrease in heat, an increase in horsepower, and near complete remediation of the exhaust profile.

Combustion Efficiency: A gasoline-based fuel-air mixture creates an exhaust profile that is fundamentally different when ignited in the presence of a conventional spark plug as compared to a plasma field. The increased effect exerted by plasma fields on combustion dynamics results primarily from the molecular dissociation that is induced on the long-chain hydrocarbon molecules comprising the fuel by the plasma. Conventional combustion relies on the combination of (a) heat, (b) pressure, (c) effective homogeneous mixing of fuel and air molecules, and (d) an ignition source to oxidize hydrocarbon molecules by combustion. The burning of petroleum-based fuels in a pressurized environment typically creates cylinder-head pressures in the range of 450-550 psi during conventional internal combustion engine operation. In contrast, plasma-induced fuel combustion has been shown by the Russian Academy of Science to create cylinder-head pressures in the range of 1120 psi under identical conditions.

The advantage of the use of a plasma-induced combustion cycle is that half the fuel mass normally combusted in a typical internal combustion engine-system can be oxidized to create the same work-function output values, all other variables remaining unchanged.

The inventive plasma ignition plug may also include mono atomic gold super conductors or orbitally reordered monotonic elements (ORME) within the emitter. Such ORME may comprise mono atomic transitional group eleven metallic powders, i.e., copper, silver, and gold. These powders exhibit type two super conductivity in the presence of high voltage in EM fields and induce type one super conductivity in contiguous copper and copper alloys.

The control of switching rates relies on maximum switching speeds of up to one hundred thousand cycles per minute at six hundred nanoseconds per pulse. Preferably, achievable switching rates include fifty nanosecond rise time plasma field propagation, two hundred nanosecond plasma field persistence, fifty nanosecond shutoff discriminator, fifty nanosecond rise time combustion arc, two hundred nanosecond combustion arc duration at one hundred times surface area, and fifty nanosecond shutoff discriminator. The increased electrical discharge levels preferably have an operating range of 13.5 volts DC at one hundred amps up to seventy-five thousand volts DC at 7.5 amps. The plasma field is preferably less than or equal to 13.5 volts DC at forty-one thousand, six hundred sixty amps pulsed at two hundred nanoseconds. The combustion arc is preferably less than or equal to seventy five thousand volts DC at 7.5 amps pulsed at two hundred nanoseconds. The air:fuel ratio is preferably adjusted from 14:7-1 up to 14:40-1. The ignition timing adjustment is preferably digitally controlled to forty degrees before top dead center.

In conjunction with the inventive plasma ignition plug, the electrical discharge cycle is also improved by advances in the ignition switching, the transformer coil, and the spark plug wiring harness. The transformer coil includes a novel electromagnetic core made from a nano-crystalline electromagnetic core material. Such nano-crystalline material exhibits zero percent hysteresis under load regardless of current levels. Vitroperm™ manufactured by Vacuum Schmelze GmbH & Co. of Hanau, Germany is a preferred example of the nano-crystalline material used.

In combination with the nano-crystalline electromagnetic core material, the system designed for the electrical discharge cycle in combination with the inventive plasma ignition plug uses a special type of cable or wire designed to carry both alternating and direct currents. The wire is constructed so as to reduce "skin effect" or "proximity effect" losses in conductors used at frequencies up to about one megahertz. Such dual current wires consist of many thin wire strands individually insulated and twisted or woven together in one of several specifically prescribed patterns often involving several layers or levels. The several levels or layers of wire strands refers to groups of twisted wires that are themselves twisted together. Such a specialized winding pattern equalizes the proportion of the overall length over which each strand is laid across the outside surface of the conductor. While such dual current wires are not superconductive, they operate with extremely low resistance to rapid pulses of VDC current in the ranges discussed herein. When used as the primary winding material for transformer coils, this dual current wire almost completely eliminates resistance losses, back eddy currents, and other losses related to transforming VDC circuits. Such dual current wire is often referred to as litz wire and is primarily used in electronics to carry alternating current.

Another novel material used in the inventive system that impacts the electrical discharge cycle is a dense core wire that incorporates intercalated tellurium 128 with highly pure copper windings—an alloyed solid core Tellurium-Copper wire. A particular version of this product goes by the brand name Tellurium-Q® manufactured by Tellurium-Q Ltd. out of England. This dense core wire was originally developed for use in high performance audiophile systems to eliminate phase distortion between the amplifier and speaker components. When used as a replacement for spark plug wires such dense core wire provides current delivery from the transformer and switching system to the inventive plasma ignition plugs with virtually zero resistance and virtually complete absence of phase distortion. This means that the signal produced at the source can be delivered without degradation to the plasma ignition plug on a continuous basis.

When a nano-crystalline electromagnetic core material such as Vitroperm™ and litz wire are combined to transform the current delivered by the alternator, they make it possible to create an integrated wire harness designed to incorporate the ignition transformer coil directly into each wire. Each wire has a separate ignition coil and switching module attached directly to its end just before it is connected to each plasma ignition plug. These integrated wire harness components are only possible because the heat losses due to resistance and hysteresis effects are virtually eliminated by the components themselves. Previous attempts to do something similar, i.e., drag racers and high performance engines used in Formula 1®, sometimes connect each spark plug wire to a separate ignition coil using digital output controllers to ensure that the output parameters do not overload the spark plugs. They also include feedback circuits and sensors tied to wireless monitoring systems. In the inventive system, each plasma ignition plug is tied to its own transformer and switching module built right into the wire itself.

In addition, a novel wire harness sheathing is utilized in the inventive system to cover the wire harness, in-line transformers, and in-line switching systems. Fibers extruded from molten lava (basalt) in 0.5 micron diameter cross-sections are collected on spools, woven together, and used for various high-tech applications. The advantage of basalt fiber materials is that they have a softening temperature of twelve hundred degrees centigrade, which is the melting point of lava rock. Such materials are three times stronger than boron-doped graphite fibers of the same diameter and can be bonded together to create insulating materials that are flexible, exhibit extremely high resistance to electrical saturation, and cannot be degraded by heat. Such material is also absolutely non-conductive and exhibits zero static electricity when exposed to magnetic fields. Such basalt fiber encasement makes the wire harness components, including the dense core wire, in-line transformers, and digital switching modules virtually indestructible and extremely durable in persistent use.

Figure 5:
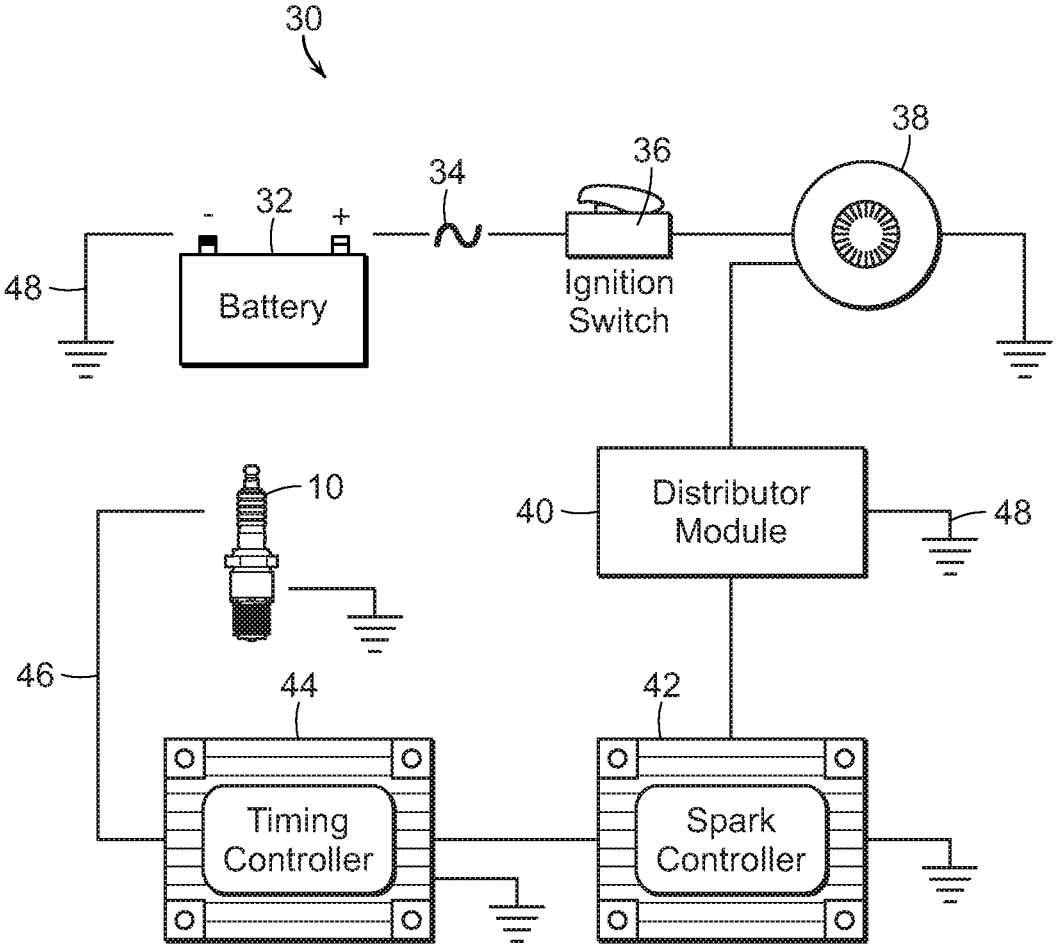
FIG. 5 is a schematic illustration of an OEM system including the inventive plasma ignition plug.

FIG. 5 schematically illustrates a system on an original equipment manufacture (OEM) engine using the inventive plasma ignition plug 10. The OEM system 30 includes the vehicle battery 32 electrically connected to a fuse 34 which is in turn electrically connected to the ignition switch 36. The ignition switch 36 is connected to the alternator 38 which supplies power to the distributor module 40. Up to this point, the OEM system 30 very closely resembles prior art designs. An output from the distributor module 40 connects to a spark controller 42 which in turn connects to a timing controller 44 that routes through a plug wire 46 to the plasma ignition plug 10. The spark controller 42, timing controller 44, and plug wire 46 are as described herein. All components of this OEM system 30 have appropriate grounding connections 48 as shown.

Figure 6:
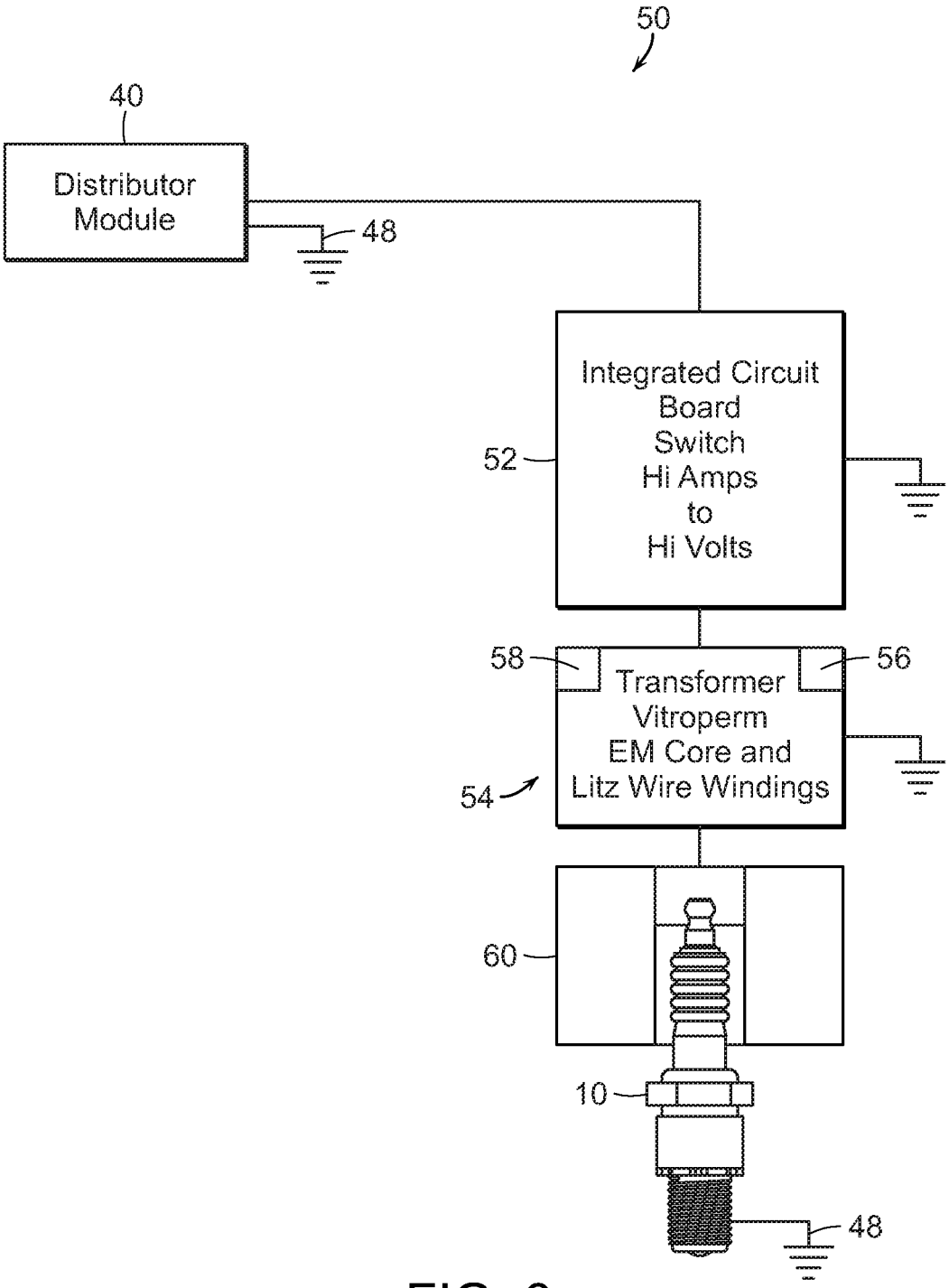
FIG. 6 is a schematic illustration of an integrated plug and wire retrofit used with the inventive plasma ignition plug.

FIG. 6 schematically illustrates an integrated plug and wire retrofit system 50 for use with the inventive plasma ignition plug 10. In this retrofit system 50, a plug wire 46 extends from the distributor module 40. Integral with the plug wire 46 is an integrated circuit board (ICB) switching element 52 and a transformer 54. The ICB switching element 52 is a high speed digitally controlled switch that is connected to the transformer 54. The transformer 54 consists of a nano-crystalline material EM torus 56 and primary and secondary windings 58 of dual current wires, i.e., litz wire. The switching element 52 and transformer 54 combine to output a pulse that is initially high amperage and then switched to high voltage. The output from the transformer 54 connects to a plug cap 60 configured to connect directly to the plasma ignition plug 10. Again each of the components has an appropriate grounding connection 48 as shown. Preferably, the ICB switching element 52 is controllable by a programmable microprocessor. The programmable microprocessor may be integrated with the ICB switching element 52 or a separate component that is connected to the ICB switching element 52 and capable of controlling the same.

Typically, the pulse switching discussed above will convert the output from the distributor module 40 first into a high amperage pulse, i.e., 13.5 volts DC at 30 amps, and then into a high voltage pulse, i.e., 50,000-75,000 volts DC at 0.0036 amps, with a total pulse duration of 200 n-sec. The purpose of the switched pulse is to take full advantage of the plasma ignition plug 10. When the plasma ignition plug 10 is pulsed with a very fast (50 n-sec) high-rise burst of high amperage (square wave at 200 n-sec duration), the air fuel mixture is molecularly dissociated into individual radicals and ions in a plasma field. The plasma field is persistent even when the source of charge has been terminated. The rate at which the source charge is fully terminated is critical to the effectiveness of the dissociation function, so the switch must convert the plasma field into an ignition field very quickly (50-100 n-sec). While the constituent radicals and individual ions are still in a dissociated plasma state, the introduction of the high voltage ignition source serves to excite the oxidation reaction with extremely high efficiency. This operates without a flame front because the entire field now operates as a single ignition point in a plasma.

That all constituents are temporarily suspended in a plasma field creates a unique circumstance. Instead of just mixing finely divided fuel droplets with intact air molecules which are by definition separated by distances in the double-digit micron range during compression, the constituent ions and radicals are held in atomic proximity. This brings then into a spatial relationship that is between 5 and 6 orders of magnitude closer than prior art fuel/air mixtures, while at the same time increasing surface area contact by a similarly exponential increase. This is one factor contributing to the conditions for complete combustion, i.e., all the ions and radicals of all the constituents. Such results in all of these constituents reacting instantaneously upon the introduction of high voltage while the plasma field continues to persist. When the constituents interact to oxidize the fuel, the amount of energy released is higher than with a prior art spark plug and ignition system because the ignition conditions have been fundamentally altered. These improvements have experimentally demonstrated a reduction in the amount of fuel to drive a load by 68%-73%, a reduction in engine operating temperature by as much as 80° F., fundamental alteration of exhaust profile, and high durability of plasma ignition plug 10.

Figure 7:
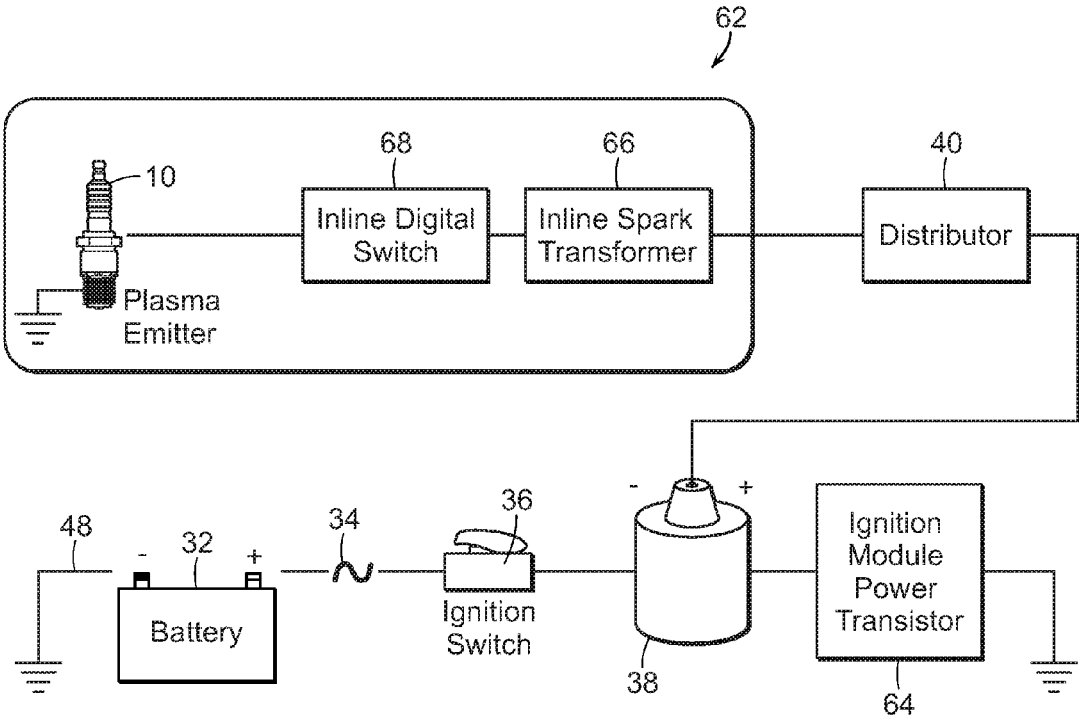
FIG. 7 is a schematic illustration of a retrofit system for use with the inventive plasma ignition plug.

An alternate retrofit system 62 is shown in FIG. 7. This alternate retrofit system 62 has a similar construction to that shown in the earlier systems including the battery 32, fuse 34, ignition switch 36, alternator 38 and distributor module 40. This system also includes an ignition module 64 electrically connected to the alternator 38. The ignition module 64 acts as a power transistor. In the alternate retrofit system 62 the plug wire 46 extends directly from the distributor module 40 and includes an inline spark transformer 66 and an inline digital switch 68 connected to the inventive plasma ignition plug 10. Again appropriate components have grounding connections 48 as shown. The retrofit replaces the original spark plug wires with the new plug wire 46 including the inline transformer 66 and digital switch 68, along with the plasma ignition plug 10.

In a particularly preferred embodiment, the inventive plasma ignition plug used in a four-cycle engine provides the following dynamics. The fuel is atomized to 0.4 micrometer diameter droplets mixed with air in a fuel injector/carburetor jet diameter of 0.056 centimeters. The air and fuel is injected into the cylinder and a ratio of 14:7-1 mixture. Plasma propagation occurs at an ignition point of twenty-two degrees before top dead center with the plasma field propagated at fifty nanosecond rise time, two hundred nanosecond duration, and fifty nanosecond shutoff duration at 13.5 volts DC at forty-one thousand, six hundred sixty amps. At these values, the plasma field disassociates long chain hydrocarbon molecules to individual ions, evenly distributed at atomic scale proximity under pressure. The following ignition arc occurs fifty nanoseconds after the collapse of the plasma field with an injection ignition impulse at seventy-five thousand volts DC at 7.5 amps for two hundred nanoseconds followed by a fifty nanosecond shutoff duration. The power stroke is driven by recombination and oxidation of the carbon fuel and oxygen ions up to sixty percent higher than conventional combustion. The exhaust stroke emissions exhibit up to forty-two percent lower carbon (2.5 PPMs), regularized NO2, regularized SO2, and virtual elimination of carbon monoxide and carbon dioxide. This plasma ignition plug produces more complete combustion with nanosecond timing intervals to reduce cylinder head temperatures by about eighty to one hundred twenty degrees Fahrenheit and exhaust temperatures by about sixty to eighty degrees Fahrenheit. When the ignition timing is adjusted to between thirty-five degrees and thirty-eight degrees before top dead center, horsepower increases by about fifteen to twenty-two percent depending upon the engine type and the fuel blend. When the air to fuel ratio is adjusted to 40:1, the break horsepower output increases with a reduction in fuel consumption by up to 62.1 percent overall.

The inventive plasma ignition plug produces similar benefits in a two-stroke engine. Two stroke exhaust emissions typically include benzene, 1,3-butadiene, benzo (a) pyrene, formaldehyde, acrolein, and other aldehydes. Carcinogenic agents exacerbate the irritation and health risks associated with such emissions. Two-stroke engines do not have a dedicated lubrication system such that the lubricant is mixed with the fuel resulting in a shorter duty cycle and life expectancy. Using the inventive plasma ignition plug, a two-stroke engine experiences ignition amplification where the normal magneto output (fifteen thousand volts DC at ten amps) is amplified about four times to sixty thousand volts at fourteen amps by virtue of the thorium-alloyed Tungsten anode. The spark discharge surface area is increased from a single spark bar (0.0181 square inches) to the halo emitter (0.0745 square inches)—an increase of 4.169 times. The total spark discharge density increase is 23.251 times. The exhaust emissions profile in a two-stroke engine shows a decrease in hydrocarbon particulates by about eighty-seven percent, elimination of carbon monoxide, conversion of NOX to NO2, conversion of SOX to SO2, elimination of benzene, reduction of 1,3 butadiene by eighty-four percent, elimination of formalins, and elimination of aldehydes. The horsepower is increased by 12.4 percent and the engine temperature is decreased from two hundred sixty degrees Fahrenheit to about one hundred eighty-seven degrees Fahrenheit at six thousand RPM.

A test series of the inventive plasma ignition plug was designed to (a) create a controlled vacuum with deliberately induced attributes, (b) visually observe and empirically measure the results of the tests, (c) conduct a series of tests based on incrementally controlled amounts of vaporized water, and (d) digitally record the test results at each segment. A testing rig consistent with the design of the plasma ignition plug 10 was constructed. In a test of a proto-type plasma ignition plug, a fly-back transformer producing 75,000 volts AC at 3.0 amps created a clearly visible plasma field. Cold ionized water vapor generated by a conventional nebulizer was vented into the plasma field in open air. The water vapor was dissociated, ionized, and detonated in open air.

As a further improvement to ignition plugs and ignition plug systems, the Applicant discloses the following additional inventive improvements.

Figure 8:
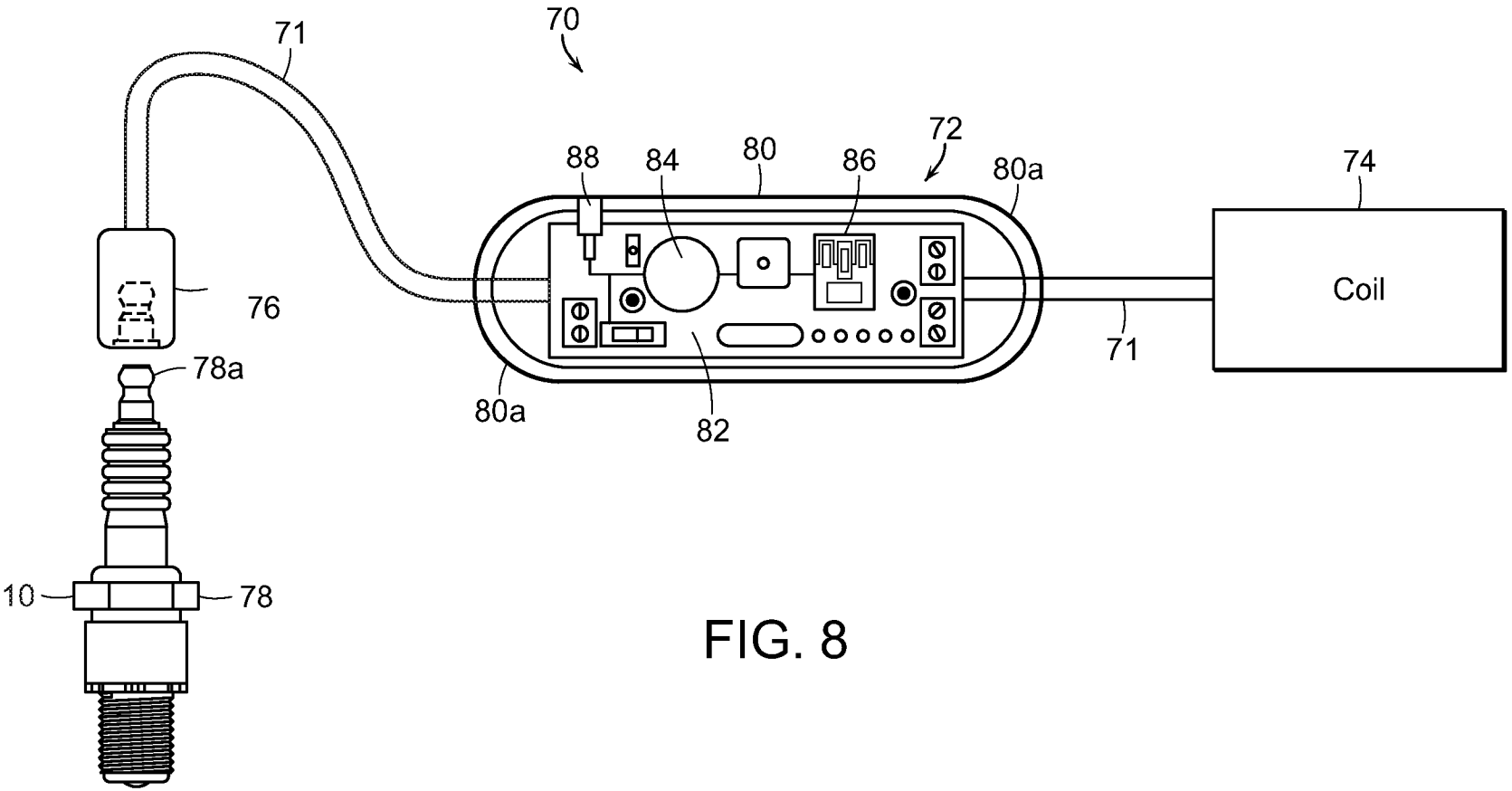
FIG. 8 is a schematic representation of an embodiment of an alternate ignition plug system of the present invention.

FIG. 8 depicts an inventive ignition plug wire 70 that includes an elongated conductor 71 having a programmable capacitor module 72 in-line between the ignition coil 74 and a connector plug 76 configured to engage the top 78*a* of ignition plug 78. In use, the elongated conductor 71 is connected at one end to the ignition coil 74, either directly or through other engine components, such as a distributor (not shown). The elongated conductor 71 is connected at a second end to the connector plug 76, which connects to the top 78*a* of an ignition plug 78. The ignition plug 78 may be a standard spark plug or a plasma ignition plug 10 as described herein.

The programmable capacitor module 72 includes a housing 80 that is generally barrel-shaped or similar 3-dimensional cylinder. The housing 80 preferably has rounded or curved ends 80*a* through which the ignition plug wire 70 passes. Despite the above preferred shapes, the housing 80 may be formed in any shape that fits in the engine compartment and accommodates the following components.

The housing 80 of the programmable capacitor module 72 encloses a printed circuit board 82 that is electrically in-line with the ignition plug wire 70 that passes through the housing 80. The printed circuit board 82 includes at least a capacitor 84, a memory chip 86, and an input port 88. Overall, the programmable capacitor module 72 may be programmed using a computing device (not shown) by interfacing with the input port 88, which is preferably a micro-USB port or similarly common interface so as to provide access to the memory chip 86 for programming purposes.

The programmable capacitor module 72 is preferably programmed to convert any voltage delivered by the ignition coil 74 into a sufficiently higher voltage in order to generate a plasma ignition field as described above. Typical ignition voltages for internal combustion engines generally range from about 15,000 volts to 20,000 volts, but other engine designs may use voltage values that fall outside of this range. Such voltages are usually sufficient to generate a "spark" across an airgap in prior art ignition spark plugs, where the airgap acts as an insulator. As the fuel/air mixture in a combustion chamber enters the airgap, the ignition voltage becomes sufficient to spark across the airgap.

The programmable capacitor module 72 is configured to step up or convert the ignition voltage to a plasma voltage, at voltages greater than 500,000 volts. Generally, such plasma voltages are in the range of 500,000 volts to 600,000 volts. As described above, such plasma voltages are sufficient to create a plasma energy field that more completely combusts hydrocarbons in the combustion chamber, including residual hydrocarbon residues that have built up on the walls of the combustion chamber and/or piston cylinder.

In addition, the programmable capacitor module 72 may convert the current from alternating current (AC) to direct current (DC). An advantage of converting to DC is the ability to have the current in a plus direction or a minus direction. With DC in a plus direction, a plasma field generated by a single plasma ignition plug 10 has a clockwise rotation. Conversely, with DC in a minus direction, the plasma field generated by the single plasma ignition plug 10 has a counter-clockwise rotation.

In a piston cylinder, a plasma field with a rotation of either clockwise or counter-clockwise creates a vortex in the cylinder. The inventors believe that the plasma vortex in the cylinder has the added ability to clean substantially all of the uncombusted hydrocarbons that may have accumulated in the cylinder over time. Such cleaning would result in combustion of such uncombusted hydrocarbons and more complete combustion of any new fuel introduced into the cylinder. More complete combustion will have the added effect of lowering emissions to the point where catalytic converters or other emission system components would be unnecessary.

Such plasma vortex and increased combustion efficiency allows for an adjustment in the typical air/fuel mixture for combustion engines. A typical air/fuel mixture for combustion engines is about 14.7 to 1. The plasma vortex allows for air/fuel mixtures as high as 40 to 1 in a single cylinder engine. In a particularly preferred embodiment, the air/fuel mixture is at about 30 to 1. Such a change in air/fuel mixtures can as much as double fuel economy and cut emissions simply by using the inventive programmable capacitor module 72.

Figure 9:
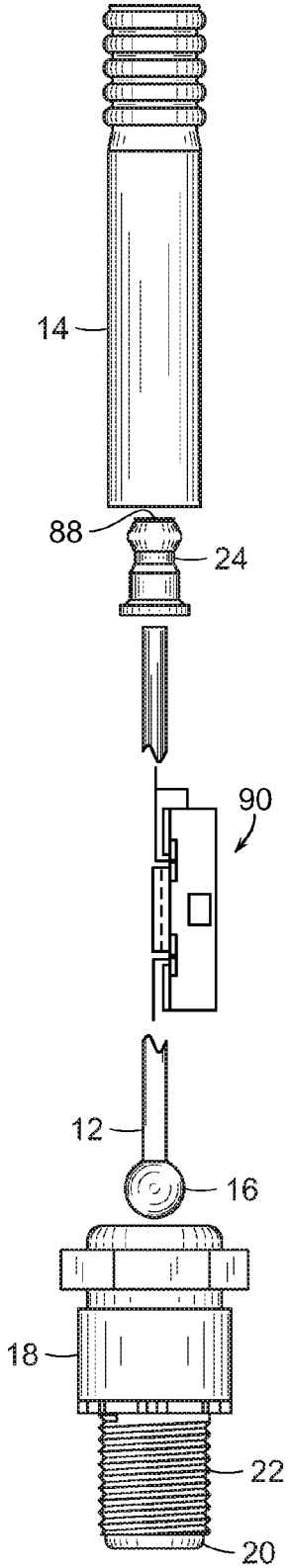
FIG. 9 is a schematic representation of an embodiment of an inventive ignition plug incorporating an embedded semiconductor circuit.
Figure 10:
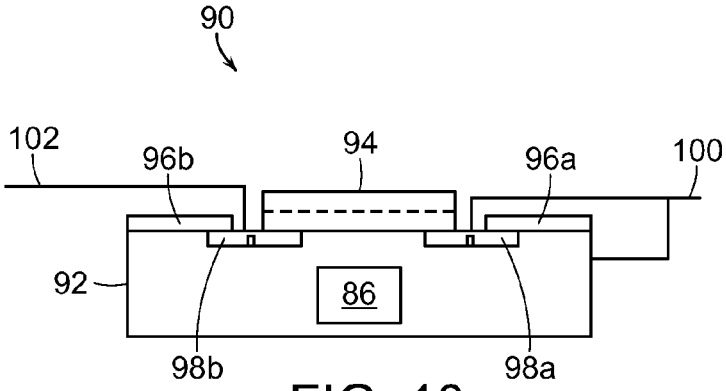
FIG. 10 is a schematic representation of the embedded semiconductor circuit of FIG. 9.

FIGS. 9 and 10 schematically depict an alternate embodiment of the inventive plasma ignition plug 10. In this embodiment, the anode 12 includes a capacitance circuit 90, preferably solely comprising the capacitance circuit 90 between the hemispherical field emitter 16 and the ignition input cap 24. As shown in FIG. 9, the tungsten anode rod 12 may be included in a two-piece form as a connector at opposite ends of the capacitance circuit 90 to the emitter 16 and the input cap 24. Alternatively, the tungsten anode rod 12 may be omitted such that the capacitance circuit 90 connects directly to the emitter 16 and the input cap 24. Such capacitance circuit 90 is preferably embedded in or enclosed by the ceramic insulator 14 as shown in the cut-away view of FIG. 10. The capacitance circuit 90 may also be included in a standard spark plug or ignition plug 78.

The capacitance circuit 90 is preferably configured as a metal-oxide-semiconductor field-effect transistor (MOSFET) designed to have a conductivity that is dependent upon the voltage supplied. The MOSFET is built upon a silicon wafer 92 or similar structure such as a printed circuit board and consists of an insulated gate 94 that connects a pair of metal-oxide terminals 96*a*, 96*b* by a corresponding pair of p-n junctions 98*a*, 98*b*. The voltage of the insulated gate 94 determines the conductivity of the circuit 90. A source terminal 100 is connected to one p-n junction 98*a* while a drain terminal 102 is connected to the other p-n junction 98*b*. In an alternative embodiment, the capacitance circuit 90 may consist of one or more capacitors mounted on and electrically connected to the silicon wafer 92, which again is embedded in the ceramic insulator 14.

In addition to the MOSFET or surface-mounted capacitors as described above, the capacitance circuit 90 may preferably include a memory chip 86. The memory chip 86 can receive a flash memory upload of a program designed to alter the degree to which the conductivity of the circuit 90 is dependent upon the voltage supplied to the gate 94. The memory chip 86 may be pre-programmed prior to the circuit 90 being embedded in the insulator 14.

In addition, the plasma ignition plug 10 may include an input port 88 as described above. The input port 88 may be included in an end of the ignition input cap 24. In this way, the memory chip 86 may be programmed through the existing ignition wire or via a separate wire, e.g., micro-USB, USB, etc., specifically intended to connect a computing terminal, e.g., laptop, tablet, smartphone, etc., (not shown) to the input port 88.

Figure 11:
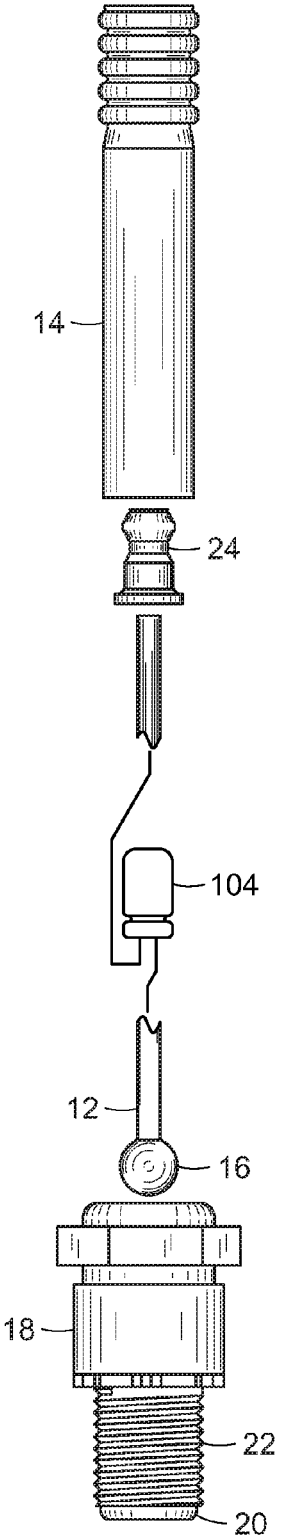
FIG. 11 is a schematic representation of an embodiment of an inventive ignition plug incorporating an embedded capacitor module.

FIG. 11 schematically depicts an alternate embodiment of the inventive plasma ignition plug 10. In this embodiment, the anode 12 includes an embedded capacitor 104 between the hemispherical field emitter 16 and the ignition input cap 24. As shown in FIG. 11, the tungsten anode rod 12 may be included in a two-piece form as a connector at opposite ends of the capacitor 104 to the emitter 16 and the input cap 24. Alternatively, the tungsten anode rod 12 may be omitted such that the capacitor 104 connects directly to the emitter 16 and the input cap 24. Such capacitor 104 is preferably embedded in or enclosed by the ceramic insulator 14 as shown in the cut-away view of FIG. 11. The capacitor 104 may also be included in a standard spark plug or ignition plug 78.

Figure 12:
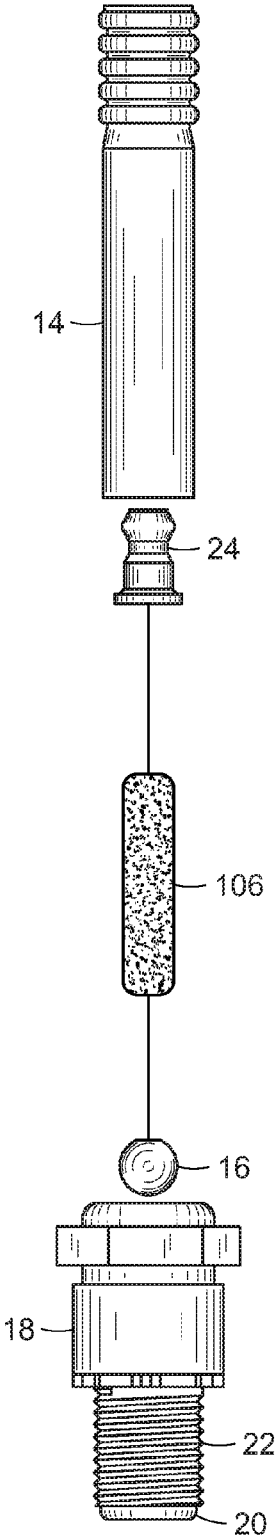
FIG. 12 is a schematic representation of an embodiment of an inventive ignition plug incorporating a composite semiconductor material.

FIG. 12 schematically depicts an alternate embodiment of the inventive plasma ignition plug 10. In this embodiment, the anode rod 12 may be replaced by a composite semiconductor material 106 enclosed within the ceramic insulator 14. Preferred forms of the composite semiconductor material 106 include metal-oxides as are typically found in semiconductor systems. The composite semiconductor material 106 preferably connects directly to the emitter 16 and the input cap 24 so as to optimize the capacitance effect of the semiconductor material 106 without resistance from the material of the tungsten rod 12 or other anode conductor. Alternatively, the tungsten rod 12 may also be included with an expanded diameter or surface area sufficient to encapsulate and/or blend with the composite semiconductor material 106, replacing a middle portion of the tungsten anode rod 12.

The composite semiconductor material 106 is preferably a metal-oxide or similarly known semiconductor material, and possesses a variable capacitance depending upon the voltage to which it is exposed. The composite semiconductor material 106 steps up an input voltage to a desirably high output voltage to the emitter, preferably in alternating current. Most preferably, the voltage is as high as 500,000 volts at a small amperage—on the order of 1 to 5 milliamps. This is contrasted with prior art spark plugs that operate at amperages in the range of 50-70 milliamps at lower voltages of about 17,000 volts.

Any existing engine could operate using the herein described inventive plasma ignition plugs 10 or inventive ignition plug wires 70 to achieve drastic improvements in efficiency and operation. The normal voltage supplied by an existing ignition coil, e.g., approximates 15,000 to 20,000 volts, can be stepped up to higher voltages using the inventive systems. The stepped up voltages would be on the order of 500,000 volts or greater.

Although various embodiments have been described in detail for purposes of illustration, various modifications may be made without departing from the scope and spirit of the invention. Accordingly, the invention is not to be limited, except as by the appended claims.

What is claimed is:

1. An ignition plug wire, comprising:

an elongated conductor having a first end configured for connection to an ignition coil and a second end configured for connection to an ignition plug;

wherein the elongated conductor is configured to deliver an ignition voltage from the ignition coil to the ignition plug; and a programmable capacitor module disposed in-line with the elongated conductor between the first end and the second end, wherein the programmable capacitor module is configured to convert the ignition voltage to a plasma voltage.

2. The ignition plug wire of claim 1, wherein the ignition voltage is in the range of 15,000 volts to 20,000 volts.

3. The ignition plug wire of claim 1, wherein the plasma voltage is greater than 500,000 volts.

4. The ignition plug wire of claim 1, wherein the programmable capacitor module comprises a memory chip connected to a capacitor that is in-line with the elongated conductor.

5. The ignition plug wire of claim 4, wherein the memory chip is configured to store a program for controlling the capacitor and how the capacitor converts the ignition voltage to the plasma voltage.

6. The ignition plug wire of claim 1, wherein the programmable capacitor module is configured to convert the ignition voltage from an alternating current to a direct current.

7. The ignition plug wire of claim 6, wherein the direct current has a plus direction and generates a plasma field having a clockwise rotation.

8. The ignition plug of claim 6, wherein the direct current has a minus direction and generates a plasma field having a counter-clockwise rotation.

9. A plasma ignition plug, comprising:

an anode concentrically disposed within a generally cylindrical cathode;

an insulator disposed between the anode and the cathode; and a voltage converting module disposed within the insulator and electrically in-line with the anode, wherein the voltage converting module is configured to convert an ignition voltage to a plasma voltage.

10. The plasma ignition plug of claim 9, wherein the voltage converting module comprises a semiconductor circuit.

11. The plasma ignition plug of claim 10, wherein the semiconductor circuit comprises a metal-oxide semiconductor field-effect transistor.

12. The plasma ignition plug of claim 10, wherein the semiconductor circuit further comprises a memory chip configured to store a program for controlling the semiconductor circuit and how the semiconductor circuit converts the ignition voltage to the plasma voltage.

13. The plasma ignition plug of claim 9, wherein the ignition voltage is in the range of 15,000 volts to 20,000 volts and the plasma voltage is greater than 500,000 volts.

14. The plasma ignition plug of claim 9, wherein the voltage converting module consists of a capacitor.

15. The plasma ignition plug of claim 9, wherein the voltage converting module comprises a composite semiconductor material in place of the anode.

16. The plasma ignition plug of claim 15, wherein the composite semiconductor material comprises a metal-oxide material.

* * * * *